US005740727A

United States Patent [19]

Shriver

[11] Patent Number: 5,740,727

[45] Date of Patent: Apr. 21, 1998

[54] CAN DECORATING APPARATUS

[75] Inventor: Frank L. Shriver, Lakewood, Colo.

[73] Assignee: Coors Brewing Company, Golden, Colo.

[21] Appl. No.: 662,789

[22] Filed: Jun. 12, 1996

[51] Int. Cl.[6] ..... B41F 17/08

[52] U.S. Cl. ..... 101/40; 101/38.1

[58] Field of Search ..... 101/40.1, 39, 40, 101/38.1

[56] References Cited

U.S. PATENT DOCUMENTS

| | | | |
|---|---|---|---|
| 1,904,332 | 4/1933 | Sidebotham | 101/40.1 |
| 2,764,933 | 10/1956 | Hargrave | 101/38.1 |
| 3,286,623 | 11/1966 | Verik | 101/40.1 |
| 3,645,201 | 2/1972 | Jackson | 101/40.1 |
| 3,934,500 | 1/1976 | Jackson | 101/40.1 |
| 4,741,266 | 5/1988 | Stirbis et al. | 101/40 |
| 4,750,420 | 6/1988 | Shriver | 101/40 |

*Primary Examiner*—John S. Hilten
*Assistant Examiner*—Leslie J. Grohusky
*Attorney, Agent, or Firm*—Klaas, Law, O'Meara & Malkin, P.C.; Joseph J. Kelly

[57] ABSTRACT

Apparatus and method for printing a decorative pattern of differing colors on the cylindrical outer surface of a can body wherein a pattern of one color is applied and dried on the outer surface and a pattern of a different color is applied to the cylindrical outer surface of the can body with only portions of the pattern of a different color superposed over portions of the pattern of one color and repeating the steps for a plurality of additional patterns and different colors.

7 Claims, 2 Drawing Sheets

CAN DECORATING APPARATUS

FIELD OF THE INVENTION

This invention relates generally to can decorating apparatus and more specifically to can decorating apparatus that increases the number of colors that may be provided on the outer surface of the can body.

BACKGROUND OF THE INVENTION

There are many types of can decorating apparatus such as those referred to in U.S. Pat. No. 4,741,266 to Stirbis et al., which patent is incorporated herein by reference thereto. As stated in the Stirbis et al. patent, the decorating apparatus of this type comprises a rotatable mandrel wheel means for supporting can body members on circumferentially spaced mandrel members; infeed means for loading undecorated can body members onto the mandrel members; a rotatable inking blanket wheel means having circumferentially spaced blanket segment members thereon for applying ink images to the can body members; a plurality of ink fountain means for holding a supply of ink of different colors; an ink transfer system associated with each ink fountain means including a plurality of circumferentially spaced ink stations each having an ink transfer roll member associated with each ink fountain means for transferring ink from the fountain means to a plate cylinder means and then to the blanket segment members; a transfer wheel means for receiving decorated can body members from the mandrel wheel means; a pin-chain means for receiving decorated can body members from the transfer wheel means and transferring the decorated can body members to a drying oven means. One of the drawbacks associated with this type of apparatus is the number of colors that can be applied to the outer surface of the can body. As described in the Stirbis et al. patent, the only available colors for printing are governed by the number of ink fountain means. In one method of increasing the number of colors for the outer surface of the can body, two or more of the plate cylinders have some areas thereof comprising a series of dots that are slightly offset so that when decorated with different colors of ink, they give the appearance of a third color of ink. While this system does produce a third color of ink, it is not always of a satisfactory appearance. Also, the alignment of the plate cylinders so that the wet ink on one plurality of dots of a plate cylinder is not transferred to the blanket segment to be superposed over another plurality of wet dots on the blanket segment from another plate cylinder presents a difficult problem.

In another embodiment of the above described apparatus, blending of colors can be achieved by a process known as wet trapping. This process involves the putting of wet ink from a plate cylinder on top of wet ink on the blanket segment member and then transferring it to the outer surface of the can body. However, after a short time the bottom ink starts to be picked up by the plate cylinder that is applying the top ink and the inks get contaminated and color quality is lost.

In conventional sheet printing of colors, it is known to achieve additional colors by a system wherein one color is printed and then dried and another color is then printed on portions of the first dried color to result in a product having at least three colors from two colors of ink. The method is repeated as many times as necessary to obtain the desired number of colors in the final product. However, applicants are not aware of any apparatus wherein a print-dry-print process has been employed to provide desired color combinations on the outer surface of a cylindrical can body.

BRIEF DESCRIPTION OF THE INVENTION

This invention provides apparatus and method for the printing of images on the cylindrical outer surface of a can body having a number of colors exceeding the number of colors in the ink fountains of the apparatus.

In a preferred embodiment of the invention, the apparatus for printing a desired multicolor pattern on the cylindrical outer surface of a can body comprises a rotatable printing wheel having a generally cylindrical outer surface and rotated by conventional means. A plurality of circumferential spaced apart plates are mounted on and project radially outwardly from the generally cylindrical outer surface. Each of the plates has printing images found thereon which printing images project radially outwardly therefrom. The printing images on each plate are different. A plurality of circumferentially spaced apart ink fountains are mounted at locations spaced from the arcuately shaped printing images in a radial direction. Each of the plurality of circumferentially spaced apart fountains having a different color of ink contained therein and having at least one movable ink applying roll and preferably at least two ink applying rolls mounted therein. Moving means are provided for moving the at least one movable ink applying roll between a first location to contact the arcuately shaped printing images and a second location not to contact the arcuately shaped printing images. Each of the plurality of circumferentially spaced apart ink fountains applies a coating of ink of a desired color to the printing images on only one of the plates. Rotatable mandrel means are provided for holding a can body having an outer cylindrical surface at a printing station to be contacted by the coating of ink on the printing images of each of the plates to transfer at least a portion of the coating of the ink onto the outer cylindrical surface of the can body. Drive means are provided for rotating the rotatable holding means and the can body. Drying means, preferably an ultra violet energy source, are provided for drying the at least a portion of the coating of ink transferred by a first one of the plates onto the cylindrical outer surface of the can body prior to being contacted by at least a second one of the plates to have at least a portion of the coating of ink on the printing images of the at least a second one of the plates transferred to the outer cylindrical surface of the can body. The drying means are mounted at a relatively fixed location. At least a portion of the coating of ink transferred to the cylindrical outer surface of the can body by the inking images on the second one of the plates is superposed over at least a portion of the dried first coating of ink on the cylindrical outer surface of the can body. Supply means are provided for holding a plurality of can bodies and transfer means are provided for moving in succession one of the plurality of can bodies from the supply means to the printing station. Conveying means are provided for receiving printing can bodies from the printing station and conveying the printed can bodies to further processing stations.

The printing wheel preferably is rotated at a constant speed and the rotatable holding means, which hold the can body for rotation therewith, are rotated by a variable speed drive. Each of the plurality of plates has a beginning end portion and the beginning end portion of the next succeeding plate is preferably spaced from the beginning end portion of its preceding plate a distance equal to about the circumference of the can body being printed. Control means are provided for controlling the rotation of the can body so that the printing images on the next succeeding plate are in proper alignment with the printed images on the cylindrical outer surface from its next preceding plate. Each plate is preferably formed from a plastic material, known as a flexo plate, which can be removably secured to the rotatable printing wheel by conventional means or from a metallic material having an arcuate shape and having edge portions thereof secured in guides on the rotatable printing wheel. The last coating applied to the cylindrical outer surface of the can body can either be dried at the printing station as the previous coating or can be transferred while wet to the conveyor means and dried at a subsequent location.

In operation, the transfer means removes a can body from the supply of can bodies and moves it to the printing station. The cylindrical outer surface of the can body is then contacted by the printing images of a first plate so that a first coating of ink of a first color is transferred to the cylindrical outer surface of the can body. As the rotation of the can body is continued, successive portions of the wet first coating of ink are passed through drying means and dried. The cylindrical outer surface of the can body is then contacted by the printing images of a second plate so that a second coating of ink of a second color is transferred to the cylindrical outer surface of the can body. At least a portion of the second coating of ink is superposed over at least a portion of the dried first coating of ink to produce shades of a color differing from the colors of the first and second coatings of ink. If additional coatings of ink of additionally differing colors of ink are to be applied to the cylindrical outer surface of the can body, the previously applied coating of ink is dried before an additional coating of ink is applied. The last applied coating of ink can either be dried at the printing station or transferred while wet to the conveyor means and dried at a subsequent location. If the last coating of ink is dried at the printing station, the printed and dried can body is transferred to the conveyor means and moved thereby to further processing location.

In another preferred embodiment of the invention, the apparatus for printing a desired multicolor pattern on the cylindrical outer surface of a can body comprises a rotatable printing wheel which has a generally cylindrical outer surface and is rotated by conventional means. A plurality of spaced apart blanket segments are mounted on and project radially outwardly from the generally cylindrical outer surface. A plurality of circumferentially spaced apart plate cylinders are mounted adjacent to but spaced from the generally cylindrical outer surface. Each of the plate cylinders has printing images formed thereon which printing images project radially outwardly therefrom. An ink fountain is provided for each of the plate cylinders and has a supply of ink contained therein and each of the ink supplies are of a different color. Coating means are provided for removing a portion of the ink from the ink fountain and forming a coating of ink on the printing images. Transfer means are provided for transferring the coating of ink on the printing images onto each of the blanket segments. The transfer means transfer the coating of ink from at least two successive print cylinders onto at least a portion of the first one-half portion of the circumferential extent of each of the blanket segments so that the transferred printing images from each of the at least two successive print cylinders are in a spaced apart relationship on the first one-half portion of the blanket segment. The transfer means transfer the coating of ink from the at least two additional successive print cylinders onto at least a portion of the second one-half portion of the circumferential extent of each of the blanket segments so that the transferred printing images from each of the at least two additional successive print cylinders are in a spaced apart relationship on the blanket segment. Rotatable holding means are provided for holding a can body having an outer cylindrical surface at a printing station to be contacted by each of the blanket segments to transfer the coating of ink on the first and second one-half portions onto the cylindrical outer surface of the can body.

Drying means are provided for at least partially drying the coating of ink transferred by the first one-half portion of the blanket segment onto the outer cylindrical surface of the can body prior to transferring the coating of ink from the second one-half portion of the blanket segment onto the outer cylindrical surface of the can body.

At least a portion of the coating of ink transferred to the cylindrical outer surface of the can body by the second one-half portion of the blanket segment is superposed over at least a portion of the at least partially dried coating of ink on the outer cylindrical surface of the can body.

A rotatable mandrel wheel has a plurality of holding means mounted thereon in a circumferentially spaced apart relationship. Rotating means are provided for rotating the rotatable mandrel wheel so that the outer cylindrical surface of the can body on each of the holding means contacts one of the blanket segments. The drying means comprise a source of drying energy located at a fixed location relative to the rotatable mandrel wheel. An annular base member is secured to the rotatable mandrel wheel for rotation therewith. An annular wall is secured to or is integral with the annular base member and projects outwardly from the annular base member in an axial direction and has an axial extent at least equal to the axial extent of the cylindrical outer surface of the can body. The annular wall has a plurality of circumferentially spaced apart slots formed therein which slots extend in an axial direction for the full axial extent of the annular wall. A radially extending passageway is provided on the annular base member and the annular wall. Each of the circumferentially spaced apart slots and the associated radially extending passageway is in radial alignment with one of the holding means so that the drying energy from the drying means contacts the cylindrical outer surface of the can body at a location diametrically opposite to the portion of the cylindrical outer surface of the can body in contact with the blanket segment.

BRIEF DESCRIPTION OF THE DRAWINGS

Preferred embodiments of the invention are illustrated in the drawing in which.

DETAILED DESCRIPTION OF THE INVENTION

Figure 1:
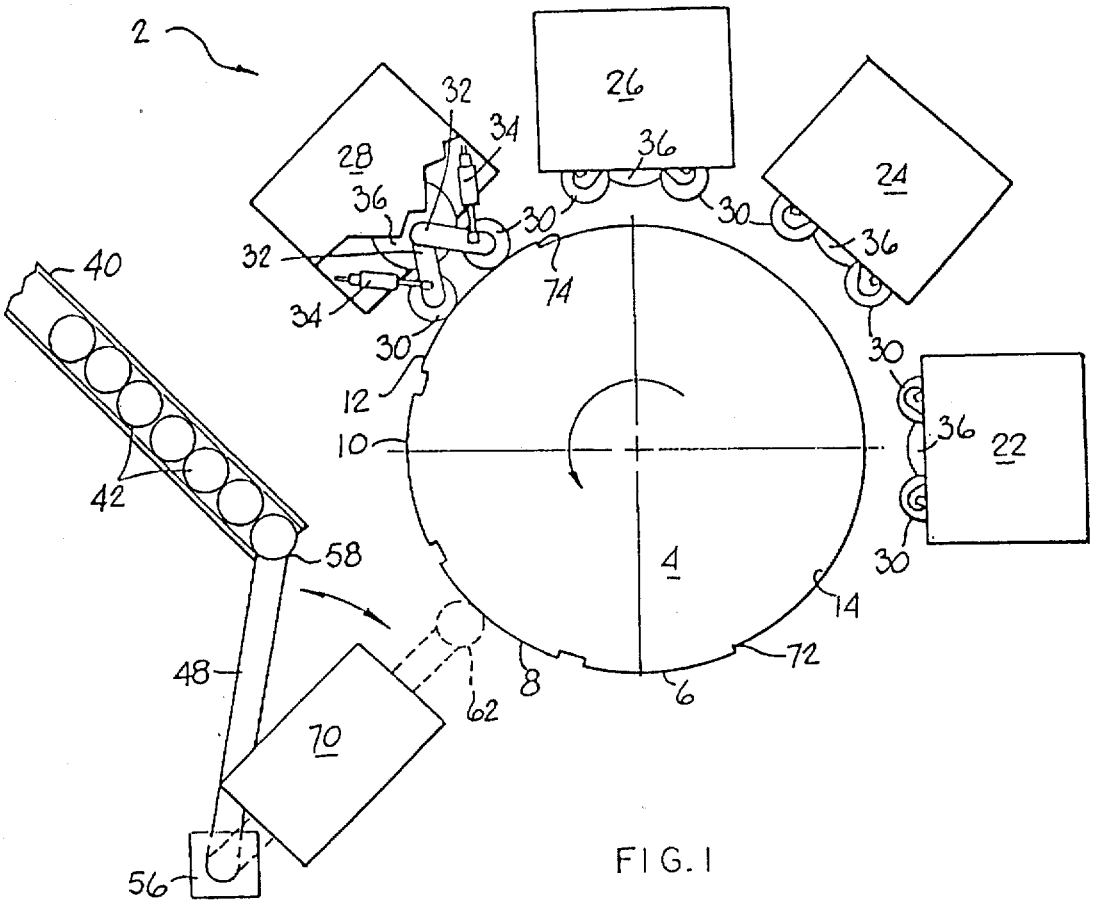
FIG. 1 is a schematic front elevational view of a portion of the apparatus of a preferred embodiment of this invention.

In FIG. 1, there is schematically illustrated apparatus 2 for accomplishing the concepts of the invention in this application. The apparatus 2 has a rotatable print wheel 4 rotated by conventional means (not shown). The print wheel 4 has a plurality of circumferentially spaced apart plates 6, 8, 10 and 12 mounted on and projecting radially outwardly from the outer cylindrical surface 14 of the printing wheel 4. Each of the plates 6, 8, 10, and 12 has printing images 16, 18, and 20 (the printing images on plate 6 are not shown) with each of the printing images being different in shape. The plates 6, 8, 10 and 12 preferably are formed from plastic material and are known in the art as flexo plates and can be removably secured to the outer cylindrical surface 14 and conformed thereto. If desired, the plates 6, 8, 10 and 12 can be formed from an arcuately shaped metallic material and secured to the outer cylindrical surface by edge portions thereof in guides on the outer cylindrical surface 14.

A plurality of circumferentially spaced apart ink fountains 22, 24, 26 and 28 are mounted at fixed locations spaced from the printing wheel 4. Each of the ink fountains 22, 24, 26 and 28 has a plurality of ink applying rolls 30 which are mounted for movement toward and away from the printing wheel 4 by pivoted arms 32 and cylinders 34. An ink transfer roll 36 transfers ink from a supply (not shown) in the ink fountain to the ink applying rolls 30. As illustrated in FIG. 1, the ink applying rolls 30 of ink fountain 28 have been moved toward the printing wheel 4 so as to contact the images 20 on the plate 12. The ink applying rolls 30 of the ink fountains 22, 24 and 26 are in a retracted position whereat they would not contact the images on any of the plates 6, 8, 10 and 12. As explained below, the ink applying rolls 30 of each of the ink fountains 22, 24, 26 and 28 contact only the printing images on one of the plates 6, 8, 10 and 12.

Figure 2:
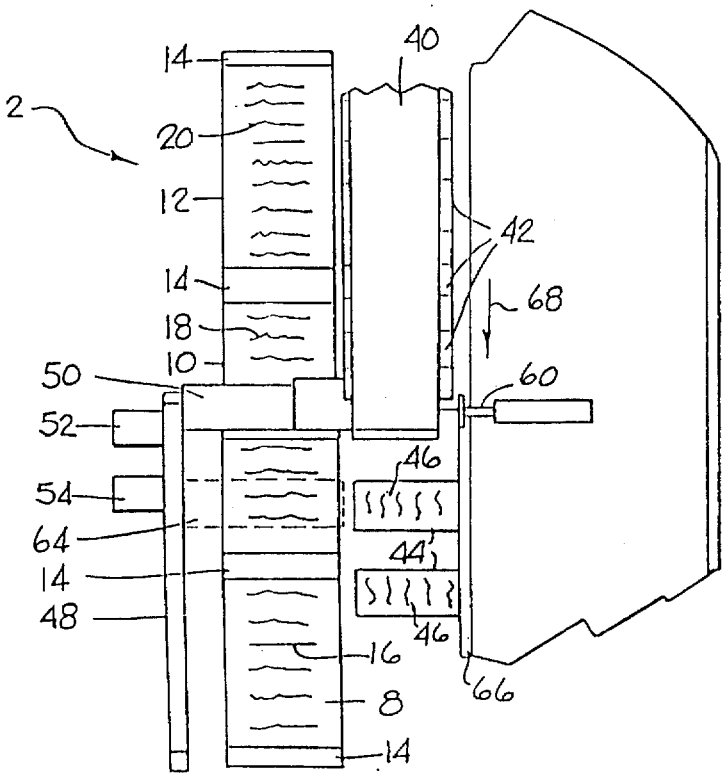
FIG. 2 is an enlarged side elevational view of FIG. 1 with parts added.

Track means 40 hold a supply of can bodies 42 each of which has an outer cylindrical surface 44 on which the final decorative pattern 46, FIG. 2, has been printed. An arm 48 has a rotatable mandrel 50 mounted thereon, FIG. 2, that is rotated by a conventional variable speed drive such as a servo motor 52. Control means 54 are provided for controlling the variable speed servo motor 52. Each mandrel 50 can be of the type illustrated and described in U.S. Pat. No. 4,750,420 issued to Shriver, which patent is incorporated herewith by reference thereto, which mandrel has a passageway therein connected to a suitable manifold for forming a vacuum therein to hold the can body 42 on the mandrel 50 or passing pressurized air therethrough which provides force applying means to blow the can body 42 off the mandrel 50. Pivot means 56 are provided for pivoting the arm 48 between a loading station 58 where a can body 42 is loaded onto a mandrel 50 using a pusher mechanism 60, FIG. 2, and vacuum in the passageway in the mandrel 50; a printing station 62 where the images are printed onto the outer cylindrical surface 44 of the can body 42 and a transfer station 64 where the can body 42 having the desired decorative pattern 46 thereon is transferred to a conveyor 66 moving in the direction of the arrow 68 to be moved to further processing operations. The vacuum in the passageway of the mandrel 50 also holds the can body 42 on the mandrel 50 for rotation therewith. It is understood that other types of holding means can be used to hold the can body 42 on the mandrel 50 for rotation therewith.

Drying means 70 are mounted at a fixed location so that the drying energy therefrom is impacted on the portion of the can body 42 that is diametrically opposite the portion of the outer cylindrical surface 44 of the can body 42 that is in contact with the printing images on one of the plates 6, 8, 10 and 12. In a preferred embodiment of the invention the drying means 70 comprises a source of ultra violet energy. However, it is understood that other types of energy sources may be used in accordance with the invention.

In a preferred embodiment of the invention, the apparatus 2 functions to transfer a can body 42 from the printing station 62 to the conveyor 66 after the images on each of the plates 6, 8, 10 and 12 have been applied to the outer cylindrical surface 44 to provide the desired dried decorative pattern 46 on the outer cylindrical surface 44 of the can body 42. After the final coating of ink applied to the outer cylindrical surface 44 of the can body 42 by the images 20 on the plate 12 has been dried by the drying means 70, the can body 42 is moved by the arm 48 from the printing station 62 to the conveyor 66. The arm 48 is then pivoted back to the loading station 58 whereat a new can body 42 is positioned onto a mandrel 50 and moved to the printing station 62. These movements of the arm 48 are made as the portion of the outer cylindrical surface 14 between the leading portion 72 of the plate 6 and the trailing portion 74 of the plate 12 is passing by the printing station 62.

In another preferred embodiment of the invention, the drying means 70 are turned off after the coating of ink applied to the outer surface cylindrical surface 44 of the can body 42 by the images 18 on the plate 10 have been dried. After the coating of ink has been applied to the outer cylinder surface 44 printing of the can body 42 by the printing images 20 on the plate 12, the can body 42 is then transferred by the arm 48 from the printing station 62 to the conveyor 66 for drying by conventional means (not shown).

In the most efficient operation of the apparatus 2 of this invention, the printing images for each different color from the plates 8, 10 and 12 are printed on the outer cylindrical surface 44 of the can body 42 as that the printing images 16, 18 and 20 from the plates 8, 10 and 12 are registered within 0.001 inch of the coating of ink applied by the printing images on the plate 6. In an acceptable operation of the apparatus 2 of this invention, the printing images for each different color from the plates 8, 10 and 12 are printed on the outer cylindrical surface 44 of the can body 42 so that the images 16, 18 and 20 from the plates 8, 10 and 12 are registered within at least 0.005 inch of the coating of ink applied by the images on the plate 6.

Ideally, the plates 6, 8, 10 and 12 are mounted on the outer cylindrical surface 14 of the printing wheel 4 so that the leading edge portion of each plate 8, 10 and 12 is spaced respectively from the leading edge portion of the plates 6, 8 and 10 a distance equal to the circumference of the outer cylindrical surface 44 of the can body 42. Thus, as the plates 6, 8, 10 and 12 and the outer cylindrical surface 44 of the can body 42 are rotated at the same surface speeds, the images therefrom would be transferred at exactly the same location on the outer cylindrical surface 44 of the can body 42. However, it is most probable that the plates 6, 8, 10 and 12 cannot be mounted that accurately. Also, it is necessary for the outer cylindrical surface 44 of the can body 42 to press into the surface of the images on each of the plates 6, 8, 10 and 12 so that the coating of ink thereon can be transferred to the outer cylindrical surface 44 of the can body 42. The amount of impression can vary due to different factors causing a change in the relative surface speeds of the outer cylindrical surface 44 of the can body 42 and each of the plates 6, 8, 10 and 12 so that a system is necessary to compensate for this variation so that the printing images will be properly located.

In the above embodiment, the printing images extend for a distance less than the circumference of the outer cylindrical surface 44. The printing images can be applied to the uncoated outer cylindrical surface 44 or the outer cylindrical surface 44 can have a base coat applied thereto in a separate operation or the first plate 6 can extend for a distance sufficient to apply a base coat to the outer cylindrical surface 44 so that the printing images can be applied to the base coat.

In another preferred embodiment of the invention, the plates 6, 8, 10 and 12 are mounted on the outer cylindrical surface 14 of the printing wheel 4 so that the leading edge portion of the plates 8, 10 and 12 is spaced respectively from the leading edge portion of the plates 6, 8 and 10 a distance greater than the circumference of the outer cylindrical surface 44 of the can body 42. This embodiment also requires a system to compensate for this variation so that the printing images will be properly located. Also, this embodiment will accommodate those instances wherein at least some of the printing images extent of the extend for the full extent of the circumference of the outer cylindrical surface 44 of the can body 42.

A preferred system for the operation of the apparatus 2 of this invention comprises the operation of the mandrel 50 by a variable speed servo drive arrangement. The printing wheel 4 will be rotated at a constant speed at whatever speed the efficient operation of the apparatus 2 will allow. Attached to the shaft of the printing wheel 4 will be a conventional resolver or tach generator which will precisely track the rotation of the printing wheel 4 so that the exact position of each of the plates 6, 8, 10 and 12 and will give an output signal of the various portions of the position of the printing wheel 4 at all times. This information will be fed to the control means 54 which will signal the servo drive 52 to orient each of the plates 8, 10 and 12 relative to the plate 6. The control means 54 are programmed so that the servo drive means 52 rotates the can body 42 a fixed number of steps for each incremental movement of the printing wheel 4. Ideally, the servo drive means 52 will rotate the can body 42 once for each of the plates 8, 10, and 12 so that the coating of ink from the printing images thereon will be properly registered with the coating of ink applied to the outer cylindrical surface 44 of the can body 42 by the printing images on the plate 6. However, due to variable, such as those described above, the rotation of the can body 42 by the servo drive means 52 will have to be adjusted. Under these conditions, the control means 54 will signal the servo drive means 52 to advance or retard the rotation of the can body 42 so that each printing image on the plates 8, 10 and 12 will start printing at the proper time on the outer cylindrical surface 44 of the can body 42.

Other systems can be used to control the operation of the apparatus 2. In a manual mode, the operator would examine the decorated outer cylindrical surface 44 to determine out of registrations and then enter corrective measures into the control means 54. In another system, vision apparatus, such as a vision system electric cell, can be used to scan each of the plates 8, 10 and 12 to determine what corrective action is required.

In the operation of the apparatus 2, the coating of ink on the printing images on the plate 6 is transferred onto the outer cylindrical surface 44 of the can body 42 and dried. The coating of ink on the printing images 16 on the plate 8 is then transferred onto the outer cylindrical surface 44 of the can body 42 and, preferably, portions of the coating of ink transferred by the plate 8 are superposed over portions of the dried coating of ink on the outer cylindrical surface 44 of the can body 42 transferred by the plate 6 and then dried. The coating of ink on the printing images 18 on the plate 10 is then transferred onto the outer cylindrical surface 44 of the can body 42 and, preferably, portions of the coating of ink transferred by the plate 10 are superposed over portions of the dried coatings of ink on the outer cylindrical surface 44 of the can body 42 from the plates 6 and 8 then dried. The coating of ink on the printing images 20 of the plate 12 is then transferred onto the outer cylindrical surface 44 of the can body 42 and, preferably, portions of the coating of ink transferred by the plate 12 are superposed over portions of the dried coatings of ink on the outer cylindrical surface 44 of the can body 42 from the plates 6, 8 and 10. As explained above, this last coating of ink is dried and the can body 42 is transferred to the conveyor 66 or the can body 42 is transferred to the conveyor 66 with the last coating of ink still wet.

Figure 3:
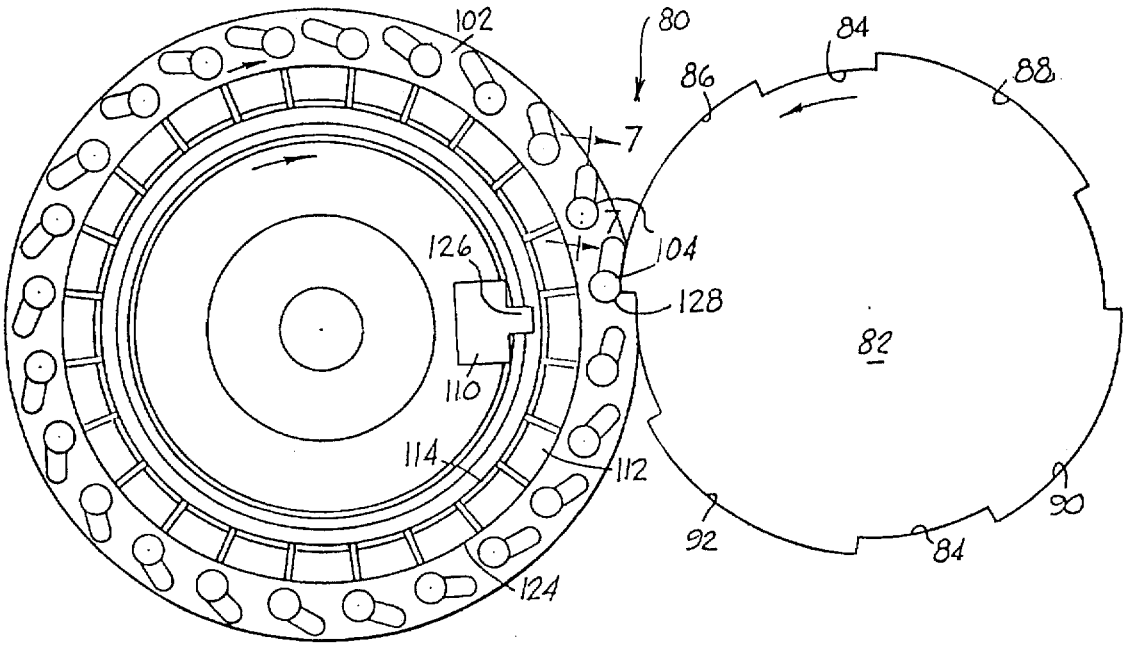
FIG. 3 is a schematic front elevational view of a portion of the apparatus of another preferred embodiment of this invention.

Another preferred embodiment of apparatus 80 of this invention is illustrated in FIG. 3. The apparatus 80 has a printing wheel 82 having a generally cylindrical outer surface 84 and is rotated by conventional means, such as those in the Stirbis et al. or Shriver patents. A plurality of blanket segments 86, 88, 90 and 92 are mounted on and project outwardly from the generally cylindrical outer surface 84. The apparatus 80 has plate cylinders, ink fountains, coating means and transfer means similar to those in the Stirbis et al. and Shriver patents to provide each of the blanket segments 86, 88, 90 and 92 with wet images of differing colors in a spaced apart relationship. If there are four plate cylinders, the apparatus 80 is operated so that two successive plate cylinders will apply two sets of wet ink images to the first one-half portion of each of the blanket segments 86, 88, 90 and 92 and the next two successive plate cylinders will apply two sets of wet images in a spaced apart relationship on the second one-half portion of each of the blanket segments 86, 88, 90 and 92. The registration of the printing images from the plate cylinders onto the blanket segments is controlled by apparatus of the type disclosed in the Stirbis et al. patent.

The apparatus 80 also comprises a rotatable mandrel wheel 102 which is rotated by conventional means (not shown), such as those described and illustrated in the Stirbis et al. and Shriver patents. Other conventional apparatus from the Stirbis et all and Shriver patents load mandrels with can bodies 104 thereon so that the outer cylindrical surface of each can body 104 is moved into contact with and rotated by each of the blanket segments 86, 88, 90 and 92 so that the wet ink images on each of the blanket segments 86, 88, 90 and 92 are transferred to the outer cylindrical surface of each can body 104. The decorated can bodies would the be moved through further processing operations as illustrated and described in the Stirbis et al. and Shriver patents.

Drying means 110 are mounted at a fixed location relative to the mandrel wheel 102 and preferably comprise an ultra violet energy source. However, it is understood that any other drying source having similar drying characteristics can be used. An annular base member 112 is mounted on the rotatable mandrel wheel 102 for rotation therewith and has an annular wall 114 projecting therefrom in an axial direction. The annular wall 114 has a plurality of axially extending slots 116 formed therein which are spaced apart in a circumferential direction. Two opposite sidewalls 118 and 120 are secured to the base member 112 and the annular wall 114 and a top wall 122 is secured to or is integral with the opposite sidewalls 118 and 120 and they cooperate to form a radially extending passageway from each slot 116 in the annular wall 114 to the outer edge 124 of the annular base member 112 to guide the drying energy from the drying means 110 onto the outer surface of the can body 104. The passageway formed by the opposite sidewalls 118 and 120 and the top wall 122 is in radial alignment with the outer cylindrical surface of the can body 104 on each mandrel. As illustrated in FIGS. 3–6, as the annular base member 112 rotates with the rotatable mandrel wheel 102, the slots 116 and the passageway formed by the opposite sidewalls 118 and 120 and the top wall 122 pass the outlet 126 of the drying means 110 to permit the drying energy from the drying means 110 to pass through the passageway formed by the opposite sidewalls 118 and 120 and the top wall 122 to be directed onto the outer surface of the can body 104 to at least partially dry the coating of wet ink images on the can body 104. In some instances, the coating of wet images on the can body 104 can be completely dried. However, it is only necessary that the coating of wet ink images on the can body 104 to be dried to a degree sufficient to allow additional coatings of wet ink images to be superposed thereon without smearing as described more fully below.

Figure 4:
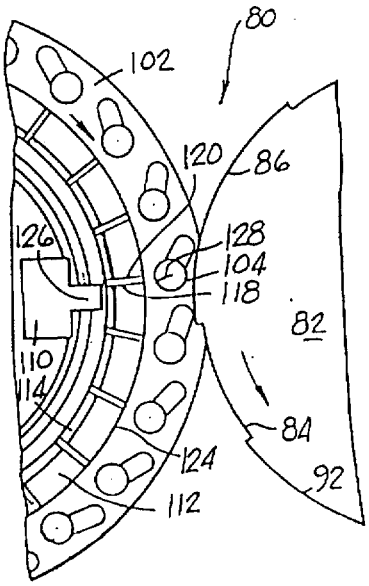
FIGS. 4–6 are portions of FIG. 3 which illustrate the various steps in the decorating of the can body.
Figure 5:
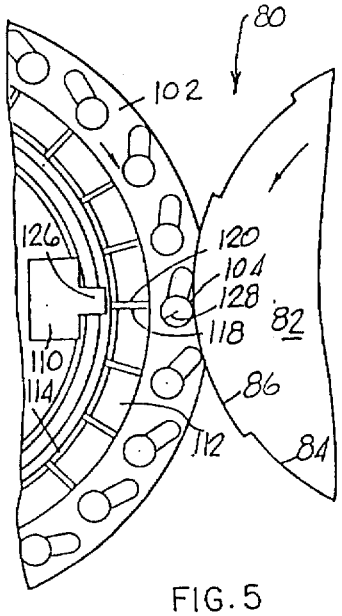
Figure 6:
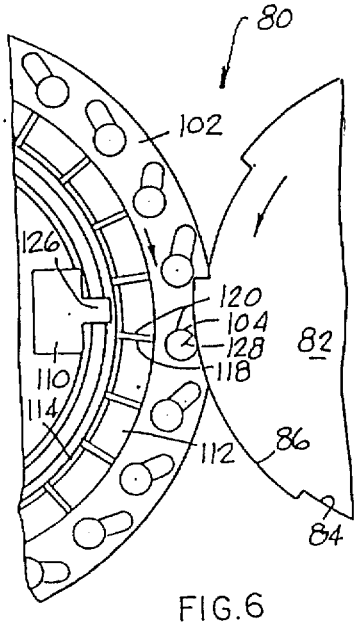
Figure 7:
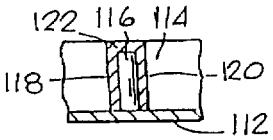
FIG. 7 is a portion of FIG. 3 showing details of the axially extending slot in annular base member 112.

In the operation of the apparatus 80, a first set of one or more plate cylinders will provide a coating of wet ink images on the first one-half circumferentially extending portion of each of the blanket segments 86, 88, 90 and 92 in sequence as they are contacted by the plate cylinders. During the rotation of the printing of the printing wheel 82, a second set of one or more plate cylinders will provide a coating of wet ink images on the second one-half circumferentially extending portion of each of the blanket segments 86, 88, 90 and 92. As illustrated in FIG. 3, the can body 104 on the mandrel wheel 102 has been moved into contact with the first portion of the blanket segment 86 to start the coating of the wet ink images on the can body 104 as indicated by the radially extending line 128. As the mandrel wheel 102 and the printing wheel 82 continue to rotate, the can body 104 rotates until the radially extending line 128 is almost in alignment with the passageway formed by the opposite sidewalls 118 and 120 as illustrated in FIG. 4 so that the coating of wet ink images on the outer surface of the can body 104 are about to be exposed to the drying energy from the drying means 110. In FIG. 5, the mandrel wheel 102 and the printing wheel 82 have almost past the outlet 126 of the drying energy and almost all of the coating of wet ink images applied to the outer surface of the can body 104 by the first one-half portion of the blanket segment 86 have been dried or at least dried to the extent of permitting an additional coating of wet ink images to be superposed on portions thereof without smearing. Also, the coating of wet ink images from the second one-half portion of the blanket segment 86 have been applied to a portion of the outer surface of the can body 014 so that portions thereof are superposed over portions of the dried or at least partially dried images from the coating of wet ink images applied by the first one-half portion of the blanket segment 86. In FIG. 6, the passageway formed by the opposite sidewalls 118 and 120 have moved out of radial alignment with the outlet 126 and the coating of wet ink images from the second one-half portion of the blanket segment 86 is almost completed. The can body 104 with the superposed images thereon is then moved by the mandrel wheel 102 to further processing operations. As the mandrel wheel 102 and the printing wheel 82 are continuously rotated, can bodies 104 are decorated by coatings of wet ink images by the blanket segments 86, 88, 90 and 92.

It is contemplated that the inventive concepts therein described may be variously otherwise embodied and it is intended that the appended claims be construed to include alternative embodiments of the inventions except insofar as limited by the prior art.

What is claimed is:

1. Apparatus for printing a desired multicolor pattern on a cylindrical outer surface of a can body comprising:

a rotatable printing wheel having a generally cylindrical outer surface;

rotating means for continuously rotating said rotatable printing wheel at a constant predetermined velocity;

a plurality of circumferential spaced apart arcuately shaped plates mounted on and projecting radially outwardly from said generally cylindrical outer surface;

each of said plates having differing arcuately shaped printing images formed thereon and projecting radially outwardly therefrom;

a plurality of circumferentially spaced apart ink fountains mounted at locations spaced from said arcuately shaped printing images in a radial direction;

each of said plurality of circumferentially spaced apart ink fountains having a different color of ink contained therein and having at least one movable ink applying roll mounted therein;

moving means for moving said at least one movable ink applying roll between a first location to contact said printing images and a second location not to contact said printing images;

each of said plurality of circumferentially spaced apart ink fountains applying a coating of ink of a desired color to said arcuately shaped printing images on only one of said arcuately shaped plates;

a stationary track for holding a plurality of can bodies;

a single pivotally mounted transfer arm;

a rotatable mandrel mounted on said transfer arm and having one exposed end;

pusher apparatus for pushing one of a plurality of can bodies on said stationary track over said one exposed end and onto said rotatable mandrel for rotation therewith;

pivot means for pivoting said transfer arm to a printing location where a can body on said rotatable mandrel may be tangentially contacted by said arcuately shaped printing images in succession to decorate a can body;

drying means located diametrically opposite to said tangential contact between a can body and said arcuately shaped printing images to cure ink deposited on a portion of a can body before said portion is in position to again be in tangential contact with another one of said arcuately shaped printing images;

a conveyor for receiving decorated can bodies and conveying them to further processing stations;

said pivot means pivoting said transfer arm from said printing location to a location adjacent to said conveyor; and force applying means to move a decorated can body off of said rotatable mandrel and onto said conveyor.

2. Apparatus as in claim 1 wherein:

at least a portion of said coating of ink transferred to a cylindrical outer surface of a can body by said at least a second one of said plates being superposed over at least a portion of said dried first coating of ink on a cylindrical outer surface of a can body.

3. Apparatus as in claim 2 including:

a motor for rotating said rotatable printing wheel at a constant speed; and a variable speed drive for rotating said rotatable mandrel.

4. Apparatus as in claim 3 wherein:

the beginning of each of said plates being spaced from the beginning of the next succeeding plate a distance equal to about the circumference of said cylindrical can body.

5. Apparatus as in claim 4 and further comprising:

control means for controlling the speed of said variable speed drive.

6. Apparatus as in claim 1 wherein said drying means comprise:

ultra violet means.

7. Apparatus as in claim 1 wherein:

said at least one movable ink applying roller comprises plurality of movable ink applying rollers.

* * * * *